United States Patent [19]

Nilssen

[11] Patent Number: 5,013,974

[45] Date of Patent: May 7, 1991

[54] ELECTRONIC BALLAST WITH IMPROVED LAMP CURRENT CREST FACTOR

[76] Inventor: Ole K. Nilssen, Caesar Dr., Rte 5 Barrington, Ill. 60010

[21] Appl. No.: 88,717

[22] Filed: Aug. 24, 1987

[51] Int. Cl.[5] ..... H05B 41/16

[52] U.S. Cl. ..... 315/244; 315/DIG. 7; 315/283; 315/174; 315/276; 331/76; 307/3; 307/5; 363/40

[58] Field of Search ..... 363/39, 40, 41, 42, 363/43; 315/170, 172, 174, 175, 176, DIG. 7, 276, 283, 209 R; 307/3, 4, 5, 73, 106, 108, 157; 331/50, 76, 117 R

[56] References Cited

U.S. PATENT DOCUMENTS

| | | | |
|---|---|---|---|
| 2,117,752 | 5/1938 | Wrathall | 363/39 X |
| 3,555,352 | 1/1971 | Michalski | 315/244 X |
| 3,983,449 | 9/1976 | Dear et al. | 315/DIG. 5 X |
| 4,007,416 | 2/1977 | Szatmari | 315/282 X |
| 4,560,908 | 12/1985 | Stupp et al. | 315/219 |
| 4,723,098 | 2/1988 | Grubs | 315/291 X |

*Primary Examiner*—Howard W. Britton
*Assistant Examiner*—Mark R. Powell

[57] ABSTRACT

An inverter-type electronic fluorescent lamp ballast powers a fluorescent lamp with a sinusoidal current that is modified by insertion of a measured amount of properly phased third harmonic current, thereby attaining a lamp current crest factor that is substantially better than the 1.4 crest factor associated with a purely sinusoidally-shaped current.

24 Claims, 1 Drawing Sheet

ELECTRONIC BALLAST WITH IMPROVED LAMP CURRENT CREST FACTOR

BACKGROUND OF THE INVENTION

1. Field of Invention

The present invention relates to means for improving the lamp current crest factor in electronic ballasts for gas discharge lamps, particularly by way of injecting a properly phased third harmonic component into an otherwise sinusoidal lamp current.

2. Description of Prior Art

A current's crest factor is defined as the ratio between its peak and RMS magnitudes.

An important characteristic of ballasts for gas discharge lamps relates to the crest factor of the current provided to the lamp. Improved lamp current crest factor means longer lamp life and improved efficiency. Most gas discharge lamps require to be powered with a current of crest factor no higher than 1.7.

In an inverter-type electronic ballast where the inverter is powered from a substantially ripple-free DC voltage, the lamp current is often nearly sinusoidal; which implies a crest factor of about 1.4—generally regarded as a very good crest factor.

However, in an inverter-type electronic ballast where the inverter is powered from a DC voltage having substantial ripple, the lamp current crest factor may be increased substantially beyond the point of 1.4—often to the point of substantially exceeding the highest crest factor permitted according to the specifications for most gas discharge lamps.

In fact, several currently available electronic ballasts exhibit lamp current crest factors of about 2.2.

SUMMARY OF THE INVENTION

Objects of the Invention

An object of the present invention is that of providing a cost-effective means for improving the lamp current crest factor of electronic ballasts.

This as well as other objects, features and advantages of the present invention will become apparent from the following description and claims.

BRIEF DESCRIPTION

In its preferred embodiment, subject invention constitutes a series-excited parallel-loaded fluorescent lamp ballast comprising the following key component parts:

a source of DC voltage, which DC voltage is derived by rectification of the AC voltage from a regular 60 Hz power line;

an inverter connected with the source of DC voltage and operative to provide across an output a high-frequency squarewave voltage;

a series LC circuit connected across the output, the LC circuit having a tank-capacitor and a tank-inductor and being substantially series-resonant at the fundamental frequency of the squarewave voltage, thereby to provide a first sinusoidal voltage across the tank-capacitor;

an auxiliary inductor means magnetically coupled to the tank-inductor of the LC circuit and tuned with an auxiliary capacitor to resonate near the third harmonic of the squarewave voltage, thereby to provide a second sinusoidal voltage across the auxiliary capacitor, the second sinusoidal voltage being of frequency three times that of the first sinusoidal voltage;

connect means operative to connect the second sinusoidal voltage in series with the first sinusoidal voltage, thereby to provide a composite ballast voltage across a pair of ballast terminals; and a fluorescent lamp connected across the ballast terminals; thereby:

(a) to provide to the fluorescent lamp a lamp current with a waveshape that approximates a squarewave and that contains a fundamental component of current having frequency equal to the fundamental frequency of the squarewave voltage as well as a third harmonic component of current having frequency equal to three times the fundamental frequency of the squarewave voltage; and (c) to provide to the fluorescent lamp a current having crest factor lower than that of a purely sinusoidally-shaped current.

DESCRIPTION OF THE PREFERRED EMBODIMENT

Details of Construction

Figure 1:
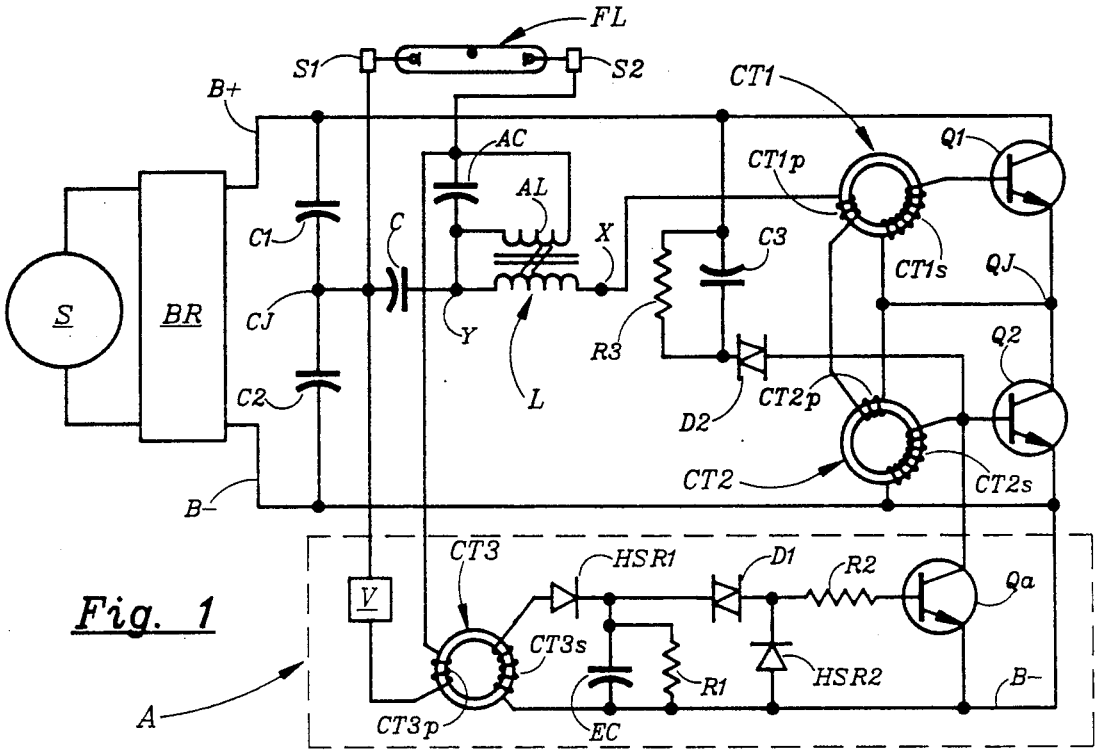
FIG. 1 schematically illustrates the preferred embodiment of the invention.

In FIG. 1, a source S of 120 Volt/60 Hz voltage is applied to a full-wave bridge rectifier BR, the unidirectional voltage output of which is applied directly between a B+ bus and a B− bus, with the positive voltage being connected to the B+ bus.

Between the B+ bus and the B− bus are connected a series-combination of two transistors Q1 and Q2 as well as a series-combination of two energy-storing capacitors C1 and C2.

The secondary winding CT1s of positive feedback current transformer CT1 is connected directly between the base and the emitter of transistor Q1; and the secondary winding CT2s of positive feedback current transformer CT2 is connected directly between the base and the emitter of transistor Q2.

The collector of transistor Q1 is connected directly with the B+ bus; the emitter of transistor Q2 is connected directly with the B− bus; and the emitter of transistor Q1 is connected directly with the collector of transistor Q2, thereby forming junction QJ.

One terminal of capacitor C1 is connected directly with the B+ bus, while the other terminal of capacitor C1 is connected with a junction CJ. One terminal of capacitor C2 is connected directly with the B− bus, while the other terminal of capacitor C2 is connected directly with junction CJ.

An inductor L and a capacitor C are connected in series with one another and with the primary windings CT1p and CT2p of current transformers CT1 and CT2.

The series-connected primary windings CT1p and CT2p are connected directly between junction QJ and a point X. Inductor L is connected with one of its terminals to point X and with the other of its terminals to another point Y; and capacitor C is connected between point Y and junction CJ.

An auxiliary capacitor AC and an auxiliary inductor AL are connected in parallel; and the resulting parallel-circuit is connected between point Y and socket S2. Another socket S1 is connected with junction CJ; and a fluorescent lamp FL is placed between sockets S1 and S2. Auxiliary inductor AL is magnetically coupled with inductor L.

A Varistor V and primary winding CT3p of current transformer CT3 are connected in series across capacitor C.

One terminal of the secondary winding CT3s of transformer CT3 is connected with the B− bus; the other terminal of this secondary winding is connected with the anode of a high speed rectifier HSR1. The cathode of rectifier HSR1 is connected to the positive terminal of an energy-storing capacitor EC. The negative terminal of capacitor EC is connected directly to the B− bus. A bleeding resistor R1 is connected directly across capacitor EC.

A Diac D1 is connected between the cathode of rectifier HSR1 and the cathode of another high speed rectifier HSR2. The anode of rectifier HSR2 is connected to the B− bus.

Between the cathode of rectifier HSR2 and the base of an auxiliary transistor Qa is connected a resistor R2.

The collector of transistor Qa is connected directly to the base of transistor Q2, and the emitter of transistor Qa is connected directly to B− bus.

The combination of varistor V, current transformer CT3, rectifier HSR1, capacitor EC, Resistor R1, Diac D1, rectifier HSR2, resistor R2 and transistor Qa is referred to as sub-assembly A.

A series-combination of a capacitor C3 and a Diac D2 is connected between the B+ bus and the base of transistor Q2. A resistor R3 is connected in parallel with capacitor C3.

Details of Operation

In FIG. 1, the source S represents an ordinary electric utility power line, the voltage from which is applied directly to the bridge rectifier identified as BR. This bridge rectifier is of conventional construction and provides for the rectified line voltage to be applied to the inverter circuit by way of the B+ bus and the B− bus.

The two energy-storing capacitors C1 and C2 are connected directly across the output of the bridge rectifier BR and serve to filter the rectified line voltage, thereby providing for the voltage between the B+ bus and the B− bus to be substantially constant. Junction CJ between the two capacitors serves to provide a power supply center tap.

The inverter circuit of FIG. 1, which represents a so-called half-bridge inverter, operates in a manner that is analogous with circuits previously described in published literature, as for instance in U.S. Pat. No. 4,184,128 entitled High Efficiency Push-Pull Inverters.

Upon initial application of power to the circuit, inverter oscillation is initiated by one or a few trigger pulses applied to the base of transistor Q2 by way of the combination of capacitor C3 and Diac D2. Once the magnitude of the B+ voltage has stabilized, due to the effect of R3, periodic additional trigger pulses will be provided.

Under normal circumstances, these additional trigger pulses will have substantially no effect on the circuit. However, if for one reason or other inverter oscillations were to be interrupted, the trigger pulses will serve to restart the oscillations.

The output of the half-bridge inverter is a substantially squarewave 30 kHz AC voltage provided between point X and junction CJ. Directly across this output is connected an L-C series circuit resonant at or near this 30 kHz. The fluorescent lamp is connected in parallel with the tank-capacitor of this L-C circuit by way of an auxiliary tuned circuit consisting of AC and AL; which auxiliary tuned circuit is resonant at or near the third harmonic of the inverter's squarewave output voltage; which is to say: the auxiliary tuned circuit is resonant at or near 90 kHz.

Thus, the high frequency voltage presented to the fluorescent lamp is the sum of the 30 kHz voltage present across tank-capacitor C and the 90 kHz voltage present across auxiliary capacitor AC.

Energy for the auxiliary tuned circuit is coupled from tank-inductor L by way of a relatively loose magnetic coupling between L and LA. Hence, just like the case with the main (30 kHz) tuned circuit, the auxiliary (90 kHz) tuned circuit constitutes a series-excited parallel-loaded tuned circuit arrangement.

In other words, the net output presented to the fluorescent lamp is a combination of two sinusoidal current sources: one at 30 kHz of a relatively large magnitude, and one at 90 kHz of a relatively small magnitude. These two current sources—being effectively connected in series with one another—feed their respective sinusoidal currents to the lamp; where the two sinusoidal currents add together to form a composite waveform.

To understand how the two tuned circuits act in effective independence of one another, thereby each to provide its output current to the common lamp load, it is important to recognize that: i) tank-capacitor C constitutes an effective short circuit for the 90 kHz current from the auxiliary tuned circuit, and ii) auxiliary inductor AL constitutes an effective short circuit for the 30 kHz current from the main L-C circuit.

The resonant or near-resonant action of the two tuned circuits provides for appropriate lamp starting and operating voltages, as well as for proper lamp current limiting; which is to say that it provides for appropriate lamp ballasting.

When the inverter is operating, the magnitude of the voltage developed across the lamp sockets (i.e., the overall ballast output terminals) is essentially only limited by the voltage-clamping characteristics of either the fluorescent lamp FL or the Varistor V—i.e., by the one which clamps at the lower voltage. If the lamp is inoperable, or if the lamp is removed from the circuit, or during the brief period before the lamp ignites, the Varistor acts as the principal voltage-clamping means; and the circuit load current then flows through this Varistor. As soon as the lamp gets into operation, however, the voltage magnitude falls to a level so low that current will no longer flow through the Varistor.

In the arrangement of FIG. 1, the various relevant voltage and current magnitudes are approximately as follows: (i) maximum required lamp starting voltage: 500 Volt RMS for not more than about 50 milli-Second; (ii) Varistor RMS and peak clamping voltage, as well as energy-handling capability: 511 Volt RMS, 750 Volt and 40 Joules, respectively; lamp operating voltage and current: 140 Volt RMS and 0.2 Amp RMS, respectively.

In a series-excited parallel-loaded resonant LC circuit, the power provided to a resistive load is approximately proportional to the magnitude of the load resistance. Hence, in FIG. 1, as long as the parameters of the two LC circuits have been arranged to provide the fluorescent lamp with its required 0.2 Amp operating current at 140 Volt RMS (which corresponds to 28

Watt), the load power resulting at higher voltages will be roughly proportionately larger. Thus, at the point where the Varistor is clamping (at about 511 Volt RMS), the power provided to the Varistor is on the order of 100 Watt. However, since the fluorescent lamp is supposed to start within 50 milli-Second, the total cumulated energy dissipation in the Varistor is limited by the lamp to about 5 Joule.

That is, under normal conditions, current will flow through the Varistor for but a very brief period of time. Thereafter, the lamp starts and the Varistor in effect gets disconnected.

However, if the lamp is inoperative or not connected, the amount of energy that would be dissipated in the Varistor would rapidly exceed its energy-handling capability. In particular, for the parameters indicated above, the maximum energy capable of being absorbed by the Varistor would be reached in 0.4 Second.

As long as current is flowing through the Varistor, it also flows through the primary winding CT3p of current-transformer CT3; which roughly implies that a corresponding output current can be obtained from the secondary winding CT3s. By way of rectifier HSR1, the positive component of this output current is used for charging energy-storing capacitor EC; which, after a brief period, accumulates a charge and develops a corresponding voltage. After this capacitor voltage has reached a magnitude high enough to cause the Diac D1 to break down, the accumulated charge on the capacitor is discharged into the base of transistor Qa—the magnitude of the discharge current being limited by the resistance of R2.

With a Diac breakdown voltage of about 30 Volt and a capacitance value of 33 uF for the energy-storing capacitor EC, the amount of charge accumulated at the point of breakdown is about 1 milli-Coulomb. Thus, if the breakdown is to occur in a time period of about 250 milli-Second (which is chosen as being a suitable value), the magnitude of the current supplied to the capacitor would have to be about 10 milli-Amp; which is indeed what is approximately provided in the circuit of FIG. 1.

Now, as the Diac breakes down, the 1 milli-Coulomb charge on capacitor EC discharges into the base of Qa—limited mainly by the resistance of R2. With the Qa transistor being thusly switched into a conductive state, albeit for just a brief moment, a very low impedance path is provided between the base and the emitter of transistor Q2. As a result, the inverter feedback path is broken and the inverter stops oscillating.

And, of course, once it has stopped oscillating, the inverter will not restart until trigger pulses are provided by way of Diac D2; which pulses will be provided periodically due to the effect of resistor R3. Thus, after a predetermined period, the inverter will restart; but, except if now operating properly, it will be disabled again almost immediately.

However, the key aspect of the present invention is associated with the combined action of the two tuned circuits: (i) the 30 kHz tuned circuit consisting of tank-inductor L and tank-capacitor C, and (ii) the 90 kHz tuned circuit consisting of auxiliary inductor AL and auxiliary capacitor AC.

The 30 kHz squarewave inverter output voltage is illustrated by FIG. 2*a;* the fundamental harmonic of this squarewave voltage is illustrated by FIG. 2*b;* the third harmonic of the squarewave voltage is illustrated by FIG. 2*c;* and the sum of the fundamental harmonic and the third harmonic is illustrated by FIG. 2*d*.

Clearly, the crest factor associated with the waveform of FIG. 2*d* is substantially lower than that associated with the sinusoidal waveform of FIG. 2*b*. In fact, with the optimum combination of a third harmonic with a fundamental harmonic, the resulting crest factor will be under 1.1; which compares with 1.4 for a pure sinewave.

Such optimum combination results when the magnitude of the third harmonic is about one third as large as that of the fundamental harmonic; which, with respect to power content, corresponds to one ninth.

Thus, the circuit of FIG. 1 is so adjusted as to provide for a situation where the magnitude of the 30 kHz current provided to the fluorescent lamp is about three times as large as that of the 90 kHz current; and the phasing is so adjusted that the two components of current add up in the manner illustrated by FIGS. 2*b*, 2*c* and 2*d*.

The adjustment may be accomplished by adjusting the magnetic coupling between tank-inductor L and auxiliary inductor AL such as to attain the proper current magnitude, and then by adjusting the capacitance value of auxiliary capacitor AC so as to attain the desired phase relationship. Since there is a substantial degree of interaction involved with these individual adjustments, iterative adjustments are necessary for optimum results.

Figure 2:
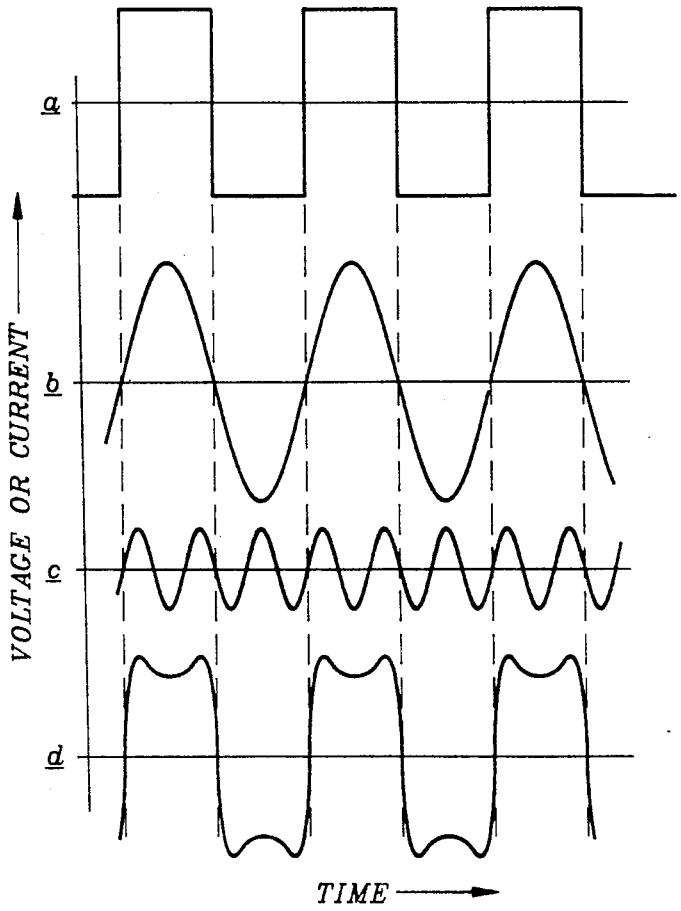
FIG. 2 shows various voltage and current waveforms associated with the preferred embodiment.

Additional Comments (a) FIG. 2 illustrates the relationships between phase and magnitude of a squarewave voltage (or current) and its two most significant harmonics (the fundamental and the third harmonic) as well as the waveform that results from adding together those two most significant harmonics.

However, the phasing between the inverter's squarewave output voltage and the resulting lamp current is not indicated in FIG. 2. In fact, the fundamental harmonic component of the lamp current is apt to be substantially phase-shifted with respect to the squarewave voltage.

On the other hand, when considered in disregard of the waveform of FIG. 2*a*, the waveforms of FIGS. 2*b*, 2*c* and 2*d* do properly illustrate the mutual phase and magnitude relationships associated with the lamp current as well as its fundamental and third harmonic component—the lamp current being illustrated by the composite waveform of FIG. 2*d*.

(b) It is particularly important to recognize that, in order to attain an improved current crest factor, the third harmonic component must be added to the fundamental harmonic component in just the right phase relationship. Otherwise, a worsening of the crest factor may actually occur.

(c) Although the current crest factor associated with the waveform of FIG. 2*d* is about 1.05, the actual lamp current crest factor may be substantially higher due to amplitude modulations on the inverter's 30 kHz squarewave output voltage; which amplitude modulations result from ripple on the DC supply voltage.

In fact, variations of the magnitude of the DC supply voltage may also be identified with a crest factor; and the net resulting lamp current crest factor will then be a combined result of the crest factor of the individual lamp current waveform (as illustrated by FIG. 2*d*) and the crest factor associated with the DC supply voltage.

In the ballast arrangement of FIG. 1, the net resulting lamp current crest factor will be very close to the product of the crest factor of the individual lamp current waveform and the crest factor of the DC supply voltage. With a 10% peak ripple voltage on the DC supply, the net overall lamp current crest factor will be about 1.15; which must still be regarded as extremely good.

In fact, even if the crest factor of the DC supply voltage were to be as high as 1.4—which would result if using unfiltered full-wave-rectified power line voltage as the DC supply voltage—the net resulting lamp current crest factor would not be much higher than about 1.5.

(d) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

What is claimed is:

1. An arrangement comprising:

a first current source operative to provide a substantially sinusoidal current of a first frequency;

a second current source operative to provide a substantially sinusoidal current of a second frequency;

a gas discharge lamp; and connect and matching means operative to connect the gas discharge lamp in circuit with both the first and the second current source, thereby to cause a lamp current to flow through the lamp, the lamp current comprising a first component of sinusoidal current of the first frequency and a second component of sinusoidal current of the second frequency.

2. The arrangement of claim 1 wherein the second frequency is three times as high as the first frequency.

3. The arrangement of claim 2 wherein the crest factor of the lamp current is lower than that associated with a purely sinusoidal current.

4. The arrangement of claim 1 combined with: (i) a source of squarewave voltage connected in circuit with both the first and the second current source, and (ii) selective circuit means operative to derive from the squarewave voltage the sinusoidal current of the first frequency as well as the sinusoidal current of the second frequency.

5. The arrangement of claim 4 wherein the source of squarewave voltage comprises frequency conversion means connected with the power line voltage of an ordinary electric utility power line and operative to convert this power line voltage to the squarewave voltage.

6. The arrangement of claim 5 wherein the fundamental frequency of the squarewave voltage is substantially higher than that of the power line voltage.

7. The arrangement of claim 5 wherein the frequency conversion means comprises: (i) rectifier means connected with the power line and operative to provide a DC voltage, and (ii) inverter means connected with the DC voltage and operative to generate the squarewave voltage.

8. The arrangement of claim 4 wherein: (i) the squarewave voltage exhibits periodic variations in magnitude, (ii) the magnitude of the sinusoidal current of the first frequency exhibits periodic variations in magnitude substantially proportional in degree to the variations in magnitude of the squarewave voltage, and (iii) the magnitude of the sinusoidal current of the second frequency exhibits periodic variations in magnitude substantially proportional in degree to the variations in magnitude of the squarewave voltage.

9. The arrangement of claim 1 wherein: (i) the first current source comprises a first L-C circuit having a natural resonance frequency near said first frequency, and (ii) the second current source comprises a second L-C circuit having a natural resonance frequency near said second frequency.

10. A combination comprising:

a source of DC voltage;

an inverter connected with the DC voltage and operative to provide a squarewave voltage at an inverter output, the squarewave voltage having a fundamental frequency;

a gas discharge lamp; and frequency-selective means connected in circuit between the inverter output and the gas discharge lamp and operative to provide to this lamp a lamp current that comprises a first sinusoidal current of frequency equal to the fundamental frequency and a second sinusoidal current having a frequency equal to three times the fundamental frequency.

11. The combination of claim 10 wherein, as long as the magnitude of the DC voltage remains substantially constant, the crest factor of the lamp current is lower than the crest factor of a purely sinusoidal waveshape.

12. The combination of claim 10 wherein, as long as the magnitude of the DC voltage remains substantially constant, the the crest factor of the lamp current is lower than 1.4.

13. The combination of claim 10 wherein the frequency-selective circuit means comprises an L-C circuit series-connected across the inverter output and operative to provide the first sinusoidal current to the gas discharge lamp, the L-C circuit having a natural resonance frequency near the fundamental frequency.

14. An arrangement comprising:

a source of squarewave voltage;

a gas discharge lamp; and coupling means connected in circuit between the squarewave voltage and the gas discharge lamp, the coupling means being operative to cause a lamp current to flow through the gas discharge lamp, the lamp current having a crest factor lower than that of a purely sinusoidal current.

15. The arrangement of claim 14 wherein the coupling means is characterized by being substantially non-dissipative, thereby to permit substantially all of the power drawn from the source of squarewave voltage by the coupling means to be supplied to the gas discharge lamp.

16. The arrangement of claim 14 wherein the lamp current is characterized by essentially consisting of only: (i) a first sinusoidal current of frequency equal to that of the fundamental harmonic component of the squarewave voltage, and (ii) a second sinusoidal current of frequency equal to three times that of the fundamental harmonic component of the squarewave voltage.

17. The arrangement of claim 14 wherein the coupling means comprises an L-C tuned circuit resonant near the frequency of the fundamental harmonic component of the squarewave voltage, the L-C tuned circuit being series-excited by the squarewave voltage and parallel-loaded by the gas discharge lamp.

18. A combination comprising:

a source of squarewave voltage, the squarewave voltage having a fundamental harmonic component and a number of higher harmonic components, including a third harmonic component;

gas discharge lamp; and filter means connected in circuit between the source of squarewave voltage and the gas discharge lamp, thereby to supply a lamp current to the gas discharge lamp, the filter means being operative to cause the lamp current to consist of the linear additive combination of: (i) a sinusoidal current flowing in response to the fundamental harmonic component of the squarewave voltage, and (ii) a sinusoidal current flowing in response to the third harmonic component of the squarewave voltage.

19. The combination of claim 18 wherein the lamp current has a crest factor lower than that of the sinusoidal current flowing in response to the fundamental harmonic component of the squarewave voltage.

20. The combination of claim 18 wherein the filter means is substantially non-dissipative, thereby to allow substantially all the power being drawn from the source of squarewave voltage by the filter means to be supplied to the gas discharge lamp.

21. A combination of:

a source of AC voltage, the AC voltage having harmonic components including a first harmonic component and a third harmonic component;

a gas discharge lamp;

a first tuned circuit coupled with the source of AC voltage and resonant at the frequency of the first harmonic component thereof, the first tuned circuit being operative to provide a first sinusoidal current from a first set of terminals, the frequency of the first sinusoidal current being equal to that of the first harmonic component;

a second tuned circuit coupled with the source of AC voltage and resonant at the frequency of the second harmonic component thereof, the second tuned circuit being operative to provide a second sinusoidal current from a second set of terminals, the frequency of the second sinusoidal current being equal to that of the third harmonic component; and coupling means: (i) connected in circuit between the gas discharge lamp and the first and second sets of terminals, and (ii) operative to cause a lamp current to be supplied to the gas discharge lamp, the lamp current comprising a combination of the first sinusoidal current and the second sinusoidal current, thereby to attain a crest factor that is lower than that of the first sinusoidal current by itself.

22. The combination of claim 21 wherein the first set of terminals is characterized as having a first impedance that is relatively high for currents of frequencies near that of the first sinusoidal current but relatively low for currents of frequencies near that of the second sinusoidal current.

23. The combination of claim 22 wherein the second set of terminals is characterized as having a second impedance that is relatively high for currents of frequencies near that of the second sinusoidal current but relatively low for currents of frequencies near that of the first sinusoidal current.

24. An arrangement comprising:

a first source of a first substantially sinusoidal current, the first substantially sinusoidal current having a first frequency;

a second source of a second substantially sinusoidal current, the second substantially sinusoidal current having a second frequency, the second frequency being three times as high as the first frequency;

a gas discharge lamp; and coupling means connected in circuit between the first source, the second source and the gas discharge lamp, thereby to supply a lamp current to the lamp from both of the two sources, the lamp current being characterized as having a crest factor lower than that of the first substantially sinusoidal current.

* * * * *